US011661956B2

(12) United States Patent
Hsieh et al.

(10) Patent No.: US 11,661,956 B2
(45) Date of Patent: May 30, 2023

(54) FAN FRAME

(71) Applicant: DELTA ELECTRONICS, INC., Taoyuan (TW)

(72) Inventors: Ming-Kai Hsieh, Taoyuan (TW); Chih-Hui Wu, Taoyuan (TW); Geng-Hua Liu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 17/528,646

(22) Filed: Nov. 17, 2021

(65) Prior Publication Data

US 2022/0074430 A1 Mar. 10, 2022

Related U.S. Application Data

(63) Continuation of application No. 16/110,236, filed on Aug. 23, 2018, now abandoned.

(Continued)

(30) Foreign Application Priority Data

Jul. 26, 2018 (CN) ..... 201810833893.6

(51) Int. Cl.

| | |
|---|---|
| ***F04D 29/66*** | (2006.01) |
| ***F04D 19/00*** | (2006.01) |
| ***F04D 29/52*** | (2006.01) |
| ***F04D 29/54*** | (2006.01) |
| ***F04D 29/02*** | (2006.01) |
| ***F04D 25/06*** | (2006.01) |

(52) U.S. Cl.

CPC ..... *F04D 29/668* (2013.01); *F04D 19/002* (2013.01); *F04D 25/0613* (2013.01); *F04D 29/023* (2013.01); *F04D 29/522* (2013.01); *F04D 29/542* (2013.01); *F05D 2300/603* (2013.01)

(58) Field of Classification Search

CPC .... F04D 29/023; F04D 29/403; F04D 29/522; F04D 29/54; F04D 29/541; F04D 29/542; F04D 29/66; F04D 29/661; F04D 29/663; F04D 29/668; F04D 25/0613; F04D 19/002; F05D 2300/603

See application file for complete search history.

(56) References Cited

U.S. PATENT DOCUMENTS 6,244,818 B1 6/2001 Chang
9,115,726 B2 8/2015 Chen (Continued)

FOREIGN PATENT DOCUMENTS

CN 104747477 A 7/2015

*Primary Examiner* — Woody A Lee, Jr.
*Assistant Examiner* — Elton K Wong
(74) *Attorney, Agent, or Firm* — Muncy, Geissler, Olds & Lowe, P.C.

(57) ABSTRACT

A fan frame includes a metal base and a frame body. The metal base has a center portion, a plurality of supporting portions with strip shapes and a plurality of wing portions. Each of the supporting portions has a head end, a middle part and a tail end. The head end connects to a peripheral part of the center portion. The wing portions extend outwardly at an angle from the middle parts of the supporting portions, respectively. The frame body has a frame wall. The wing portions are partially at least covered by the frame body. Another fan frame is also disclosed.

20 Claims, 5 Drawing Sheets

Related U.S. Application Data

(60) Provisional application No. 62/549,720, filed on Aug. 24, 2017.

(56) References Cited

U.S. PATENT DOCUMENTS

| | | | | |
|---|---|---|---|---|
| 2007/0128022 | A1 | 6/2007 | Yeh et al. | |
| 2007/0242430 | A1* | 10/2007 | Liu | F04D 25/0613 165/125 |
| 2008/0175729 | A1* | 7/2008 | Kato | F04D 29/542 417/353 |
| 2009/0142190 | A1* | 6/2009 | Horng | F04D 25/0613 415/214.1 |
| 2011/0108251 | A1* | 5/2011 | Horng | F04D 29/4226 415/182.1 |
| 2015/0023779 | A1* | 1/2015 | Li | F04D 29/646 415/208.1 |
| 2015/0226230 | A1 | 8/2015 | Chang et al. | |
| 2016/0201689 | A1* | 7/2016 | Inada | F04D 29/325 415/209.3 |

* cited by examiner

FAN FRAME

CROSS REFERENCE TO RELATED APPLICATIONS

The non-provisional patent application claims priority to U.S. provisional patent application with Ser. No. 62/549,720 filed on Aug. 24, 2017. This and all other extrinsic materials discussed herein are incorporated by reference in their entirety.

This Non-provisional application claims priority under 35 U.S.C. § 119(a) on Patent Application No(s). 201810833893.6 filed in People's Republic of China on Jul. 26, 2018, the entire contents of which are hereby incorporated by reference.

This application is a Continuation Application (CA) of an earlier filed, pending, application, having application Ser. No. 16/110,236 and filed on Aug. 23, 2018, the content of which, including drawings, is expressly incorporated by reference herein.

BACKGROUND OF THE INVENTION

Field of Invention

The present disclosure relates to a fan frame and, in particular, to a fan frame that made of metal and plastic materials.

Related Art

As the performance of electronic devices continues to increase, the electronic devices generate a large amount of waste heat during operation. If the heat cannot be immediately removed from the electronic device, the temperature of the electronic device will rise, which can cause damage to internal components and reduce the performance and lifetime of the electronic device. A fan is a heat dissipation device widely used in the electronic devices for removing the large amount of waste heat away from the electronic devices. If the fan of the same size is selected, the fan speed must be increased to enhance the heat dissipation efficiency of the fan. However, in the conventional fan product, the fan frame is usually made of a single plastic material. As the rotation speed increases, the fan will generate an obvious vibration, and the fan frame, which is made of the single plastic material, can induce the resonance effect to concentrate and amplify the vibration source. This situation can result in the noise of the fan or even the situation of unstable operation of fan.

Therefore, it is desired to provide a fan frame that is made of different materials, so that the vibration of the fan frame can be dispersed by the combination of different material properties, thereby preventing the resonance of the fan frame, stabling the fan operation, and reducing the noise.

SUMMARY OF THE INVENTION

An objective of this disclosure is to provide a fan frame. Different from the conventional fan frame, the fan frame of this disclosure is made of different materials, so that the vibration of the fan frame can be dispersed by the combination of different material properties, thereby preventing the resonance of the fan frame, stabling the fan operation, and reducing the noise.

This disclosure provides a fan frame comprising a frame body and a metal base. The frame body has a frame wall.

The metal base comprises a center portion and a plurality of static blades radially extending from the center portion outwardly and connecting to the frame wall.

In one embodiment, each of the static blades comprises a supporting portion and a wing portion extending outwardly from the supporting portion.

In one embodiment, the frame body covers the supporting portions and at least one part of the wing portions.

In one embodiment, the fan frame further comprises a peripheral connection portion, and the static blades connect to the frame wall through the peripheral connection portion.

In one embodiment, the center portion, the peripheral connection portion and the static blades are integrally formed as one piece.

In one embodiment, a height of the frame wall is greater than a height of the peripheral connection portion.

In one embodiment, a height of the peripheral connection portion is greater than a thickness of the center portion.

The present disclosure also provides a fan frame comprising a base and a frame body. The frame body comprises at least one metal frame wall and a plurality of static blades radially extending from the metal frame wall inwardly and connecting to the base.

In one embodiment, each of the static blades comprises a supporting portion and a wing portion extending outwardly from the supporting portion.

In one embodiment, the frame body covers the supporting portions and at least one part of the wing portions.

In one embodiment, the fan frame further comprises a center connection portion, and the static blades connect to the base through the center connection portion.

In one embodiment, the center connection portion, the static blades and the metal frame wall are integrally formed as one piece.

In one embodiment, a height of the metal frame wall is greater than a thickness of the center connection portion.

In one embodiment, a height of the frame body is greater than a height of the metal frame wall.

This disclosure further provides a fan frame comprising a frame body, a base, and a plurality of static blades. The frame body has a frame wall. One end of each static blade connects to the base, and the other end of each static blade connects to the frame wall. At least one part of the static blades is made of metal.

In one embodiment, each of the static blades comprises a supporting portion and a wing portion extending outwardly from the supporting portion.

In one embodiment, the frame body covers the supporting portions and at least one part of the wing portions.

In one embodiment, the fan frame further comprises a center connection portion, and the static blades connect to the base through the center connection portion.

In one embodiment, the fan frame further comprises a peripheral connection portion, and the static blades connect to the frame wall through the peripheral connection portion.

In one embodiment, a height of the frame wall is greater than a height of the peripheral connection portion.

In one embodiment, a height of the peripheral connection portion is greater than a thickness of the center connection portion.

As mentioned above, the fan frame of this disclosure contains different materials, which have different vibration properties. Accordingly, the static blades and other portions of the fan frame, which are made of different materials, can disperse the vibration of the fan frame, thereby preventing the resonance of the fan frame. Compared with the convention fan, the fan configured with the fan frame of this disclosure can stably operate and reduce the generated noise, thereby extending the lifetime of the fan and maintaining the operation performance of the fan. In addition, although the fan frame is made of different materials, it is still possible to provide one material to cover a part of the other material, so that the fan frame can be manufactured as an integrated piece. This configuration can decrease the manufacturing cost and speed the manufacturing process.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

The fan frame of this disclosure can make the fan to stably operate and reduce the generated noise, thereby extending the lifetime of the fan and maintaining the operation performance of the fan. The structure and features of the fan frame of this disclosure will be described in the following embodiments.

Figure 1A:
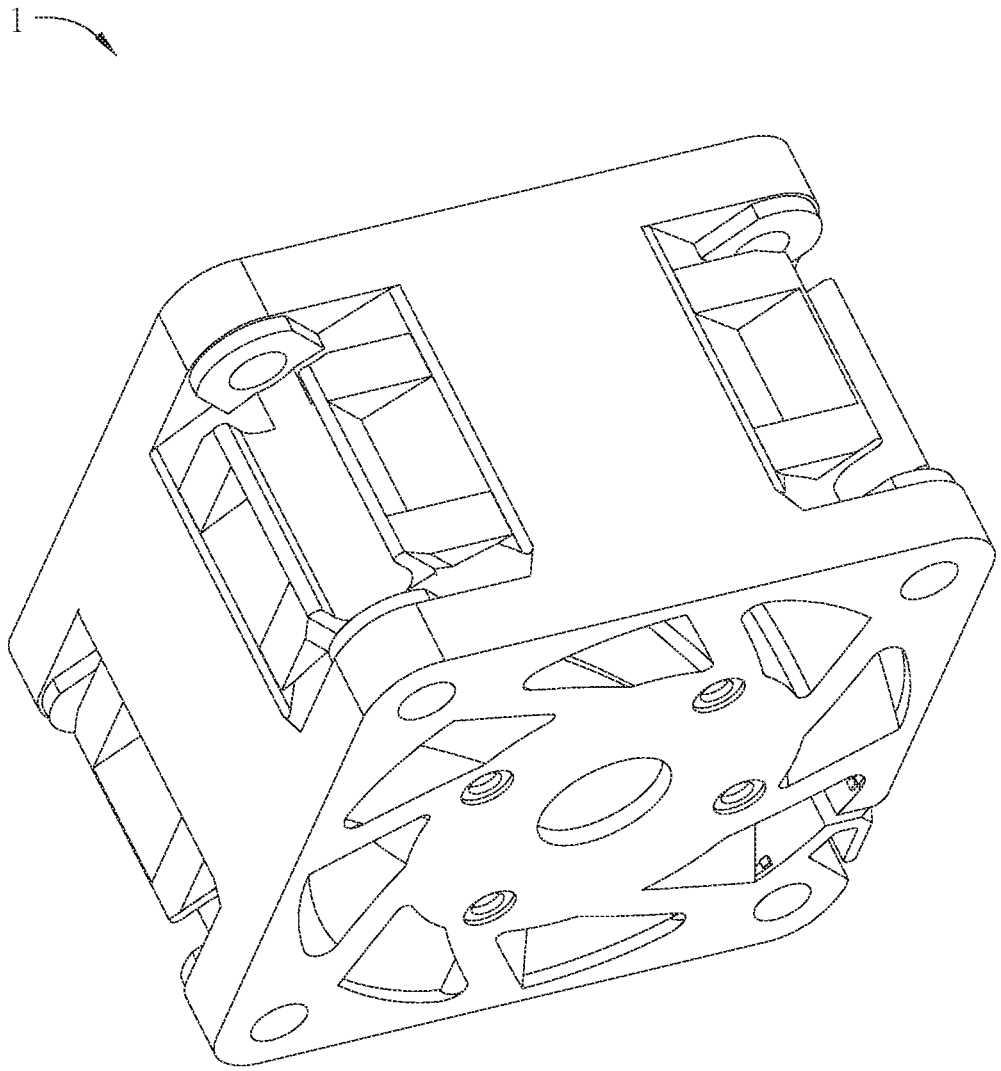
FIG. 1A is a schematic diagram showing a fan frame according to an embodiment of this disclosure.
Figure 1B:
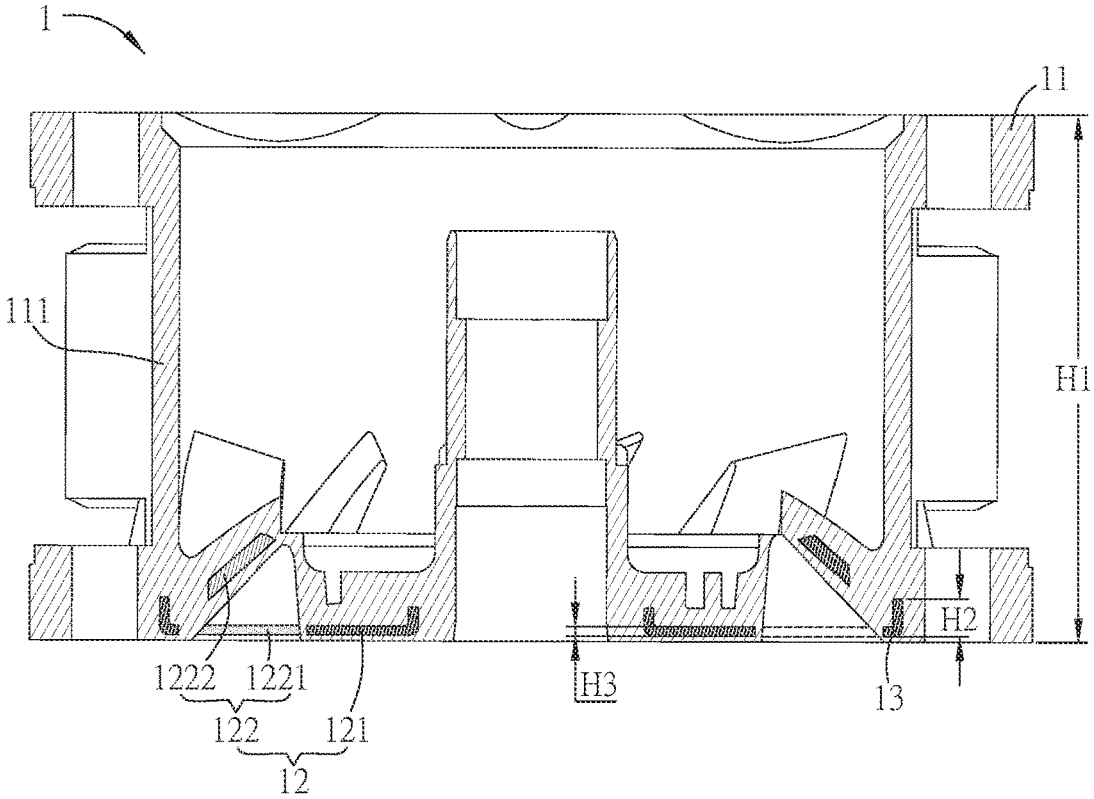
FIG. 1B is a sectional view of the fan frame of FIG. 1A.
Figure 1C:
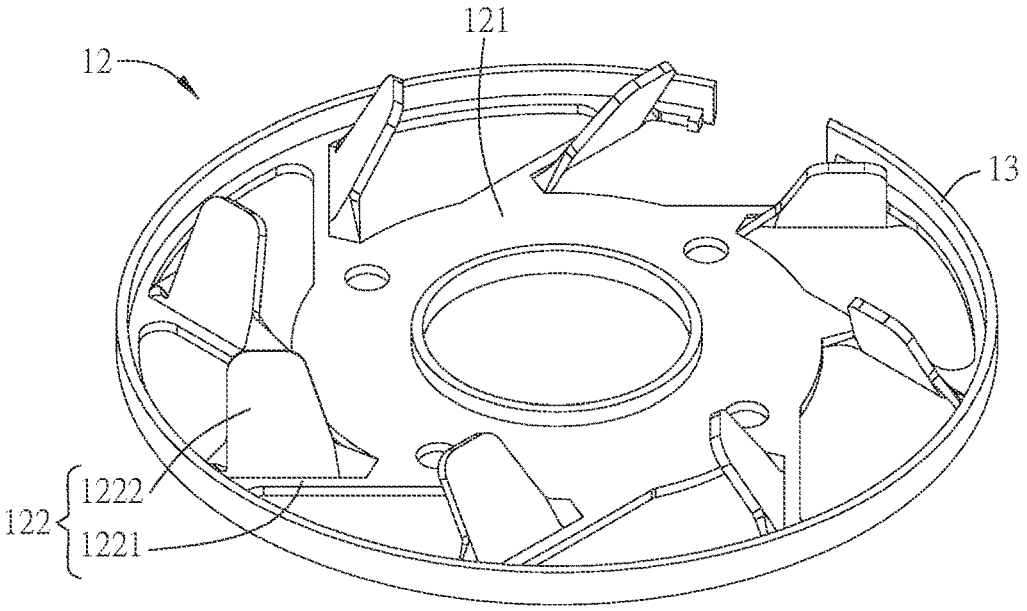
FIG. 1C is a schematic diagram showing the metal base of FIG. 1B.

FIGS. 1A to 1C are schematic diagrams showing a fan frame 1 according to an embodiment of this disclosure.

The fan frame 1 comprises a frame body 11 and a metal base 12. The metal base 12 can be assembled with the frame body or be covered by and disposed inside the frame body 11.

The frame body 11 comprises a frame wall 111. The metal base 12 comprises a center portion 121 and a plurality of static blades 122. The static blades 122 radially extend from the center portion 121 outwardly and connect to the frame wall 111.

In this embodiment, each static blade 122 comprises a supporting portion 1221 and a wing portion 1222 extending outwardly from the supporting portion 1221. The frame body 11 covers the supporting portions 1221 and at least one part of the wing portions 1222. For example, the frame body 11 may cover the entire metal base 12, which includes the center portion 121, the static blades 122 (including the supporting portions 1221 and the wing portions 1222). Alternatively, the frame body 11 may cover the center portion 121 of the metal base 12 only. Alternatively, the frame body 11 may cover the center portion 121 of the metal base 12 and the supporting portions 1221 of the static blades 122. Alternatively, the frame body 11 may cover the center portion 121 of the metal base 12, the supporting portions of the static blades 122, and a part of the wing portions 1222 of the static blades 122. Alternatively, the frame body 11 may cover the supporting portions of the static blades 122 and a part of the wing portions 1222 of the static blades 122. Alternatively, the frame body 11 may cover the wing portions 1222 of the static blades 122 of the metal base 12 only. In this embodiment, the frame body 11 is made of plastic material, and the center portion 121 of the metal base 12 can be, for example but not limited to, all made of metal, a part of plastic material and a part of metal, an inner metal layer with a partial external plastic layer, or an inner metal layer with an external plastic layer. This disclosure is not limited. In addition, the static blades 122 can be, for example, all made of metal, partially covered by the frame body 11 to form a part of plastic material and a part of metal, an inner metal layer with a partial external plastic layer, or an inner metal layer with an external plastic layer. This disclosure is not limited. The design of the materials of the center portion 121 and the static blades 122 can increase the effective air quantity and airflow speed outputted by the operating fan containing the fan frame 1 of this disclosure. In addition, the configuration of the combination of different materials can disperse the resonance of the frame body for blocking the direct transmission of the vibration source, thereby decreasing the transmitted energy from the vibration source. Thus, the fan frame 1 of this disclosure can provide the effect of reducing the operation noise.

In this embodiment, the fan frame 1 further comprises a peripheral connection portion 13, and the static blades 122 connect to the frame wall 111 through the peripheral connection portion 13. As shown in FIG. 1C, the center portion 121, the peripheral connection portion 13, and the static blades 122 are integrally formed as one piece. In particular, although the figure shows that the center portion 121, the peripheral connection portion 13, and the static blades 122 are integrally formed as one piece, the peripheral connection portion 13, in practice, can be an individual structure separated from the center portion 121 and the static blades 122. This disclosure is not limited. As shown in FIG. 1C, the peripheral connection portion 13 is an annular structure. Of course, the peripheral connection portion 13 can also be a polygonal structure, an arc structure, a circular structure, an elliptical structure, or an irregular structure, and this disclosure is not limited. Referring to FIG. 1C, the peripheral connection portion 13, for example, connects to all of the static blades 122. In other embodiments, the peripheral connection portion 13 can connect to two or more of the static blades 122 only, and this disclosure is not limited thereto.

In this embodiment, a height H1 of the frame wall 111 is greater than a height H2 of the peripheral connection portion 13, and the height H2 of the peripheral connection portion 13 is greater than a thickness H3 of the center portion 121. This design of different heights can effectively decrease the operation noise of the fan configured with the fan frame 1 of this disclosure.

Figure 2A:
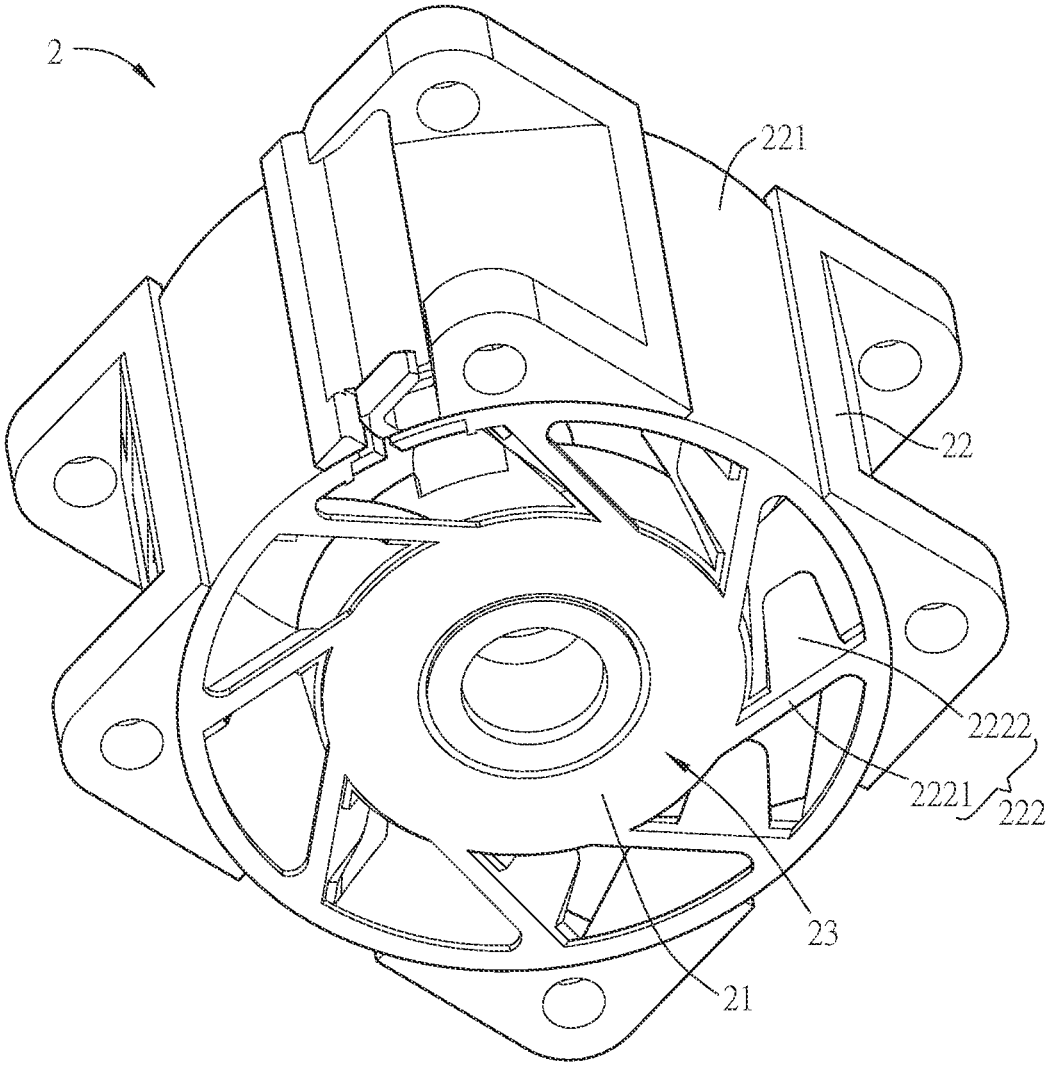
FIG. 2A is a schematic diagram showing a fan frame according to another embodiment of this disclosure.
Figure 2B:
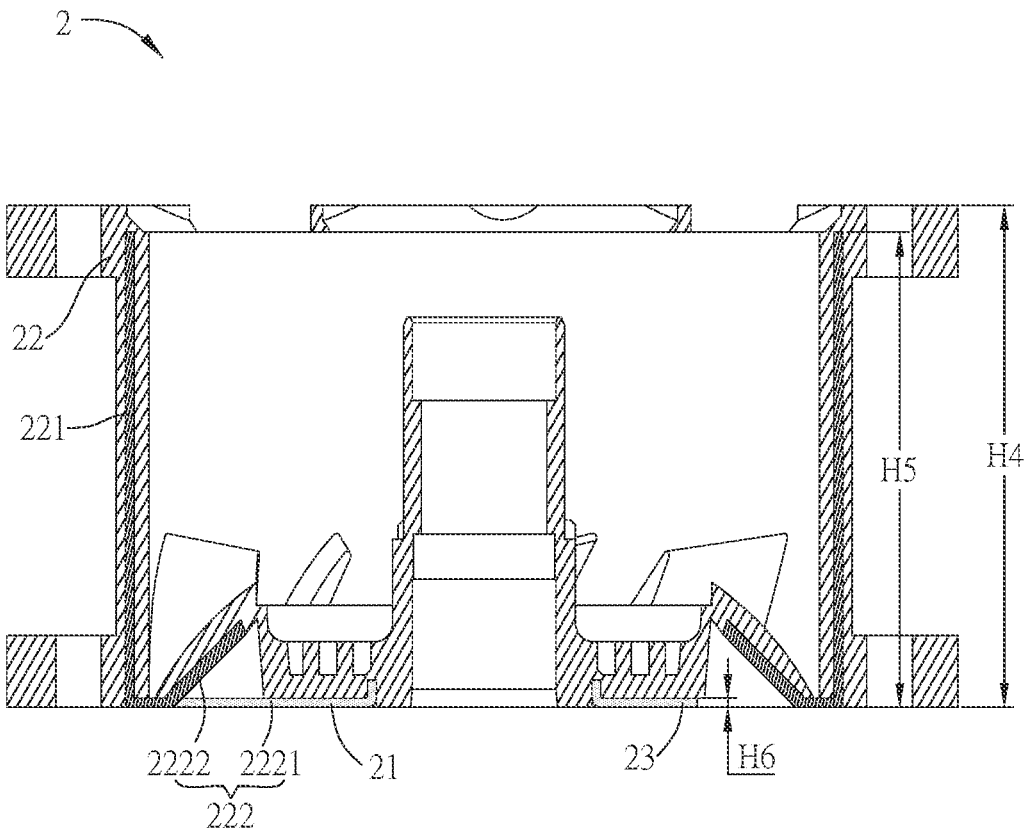
FIG. 2B is a sectional view of the fan frame of FIG. 2A.

FIGS. 2A and 2B are schematic diagrams showing a fan frame 2 according to another embodiment of this disclosure.

Referring to FIGS. 2A and 2B, the fan frame 2 comprises a base 21, a frame body 22, at least one metal frame wall 221, and a plurality of static blades 222. The static blades 222 radially extend from the metal frame wall 221 inwardly and connect to the base 21. The frame wall of the fan frame 2 is defined by the frame body 22 and the metal frame wall 221, and the metal frame wall 221 is connected to the base 21. In this embodiment, the metal frame wall 221 can be a structure assembled with the frame body 22 or be at least partially covered by the frame body 22. In particular, the fan frame 2 of this embodiment includes one metal frame wall 221 only. As shown in FIG. 2A, the metal frame wall 221 is a structure disposed at the periphery of the fan frame 2. In practice, the amount of the metal frame walls 221 can be changed based on the requirement of the user. For example, the fan frame 2 may include two semicircular metal frame walls 221 for forming the circular fan frame structure. In addition, the fan frame 2 may include more than two metal frame walls 221 for forming the circular fan frame structure. The metal frame walls 221 may not connect to each other. This disclosure is not limited thereto.

In this embodiment, each static blade 222 comprises a supporting portion 2221 and a wing portion 2222 extending outwardly from the supporting portion 2221. As shown in FIG. 2B, the frame body 22 covers the supporting portions 2221 and at least one part of the wing portions 2222. For example, the frame body 22 may cover the entire metal frame wall 221 and the static blades 222. Alternatively, the frame body 22 may cover the entire metal frame wall 221 only. Alternatively, the frame body 22 may cover a part of the metal frame wall 221. Alternatively, the frame body 22 may cover the metal frame wall 221 and the supporting portions 2221 of the static blades 222. Alternatively, the frame body 22 may cover the metal frame wall 221, the supporting portions 2221 of the static blades 222, and a part of the wing portions 2222 of the static blades 222. Alternatively, the frame body 22 may cover the supporting portions 2221 of the static blades 222 and a part of the wing portions 2222 of the static blades 222. Alternatively, the frame body 2 may cover the wing portions 2222 of the static blades 222 only. In this embodiment, the frame body 22 is preferably made of plastic material, and the metal frame wall 221 can be, for example but not limited to, all made of metal, a part of plastic material and a part of metal (the metal frame wall 221 is at least partially covered by the frame body 22), an inner metal layer with a partial external plastic layer, or an inner metal layer with an external plastic layer. This disclosure is not limited. In addition, the static blades 222 can be, for example, all made of metal, a part of plastic material and a part of metal, an inner metal layer with a partial external plastic layer, or an inner metal layer with an external plastic layer. This disclosure is not limited. The design of the materials of the frame body 22, the metal frame wall 221 and the static blades 122 can increase the effective air quantity and airflow speed outputted by the operating fan containing the fan frame 2 of this disclosure. In addition, the configuration of the combination of different materials can disperse the resonance of the frame body for blocking the direct transmission of the vibration source, thereby decreasing the transmitted energy from the vibration source. Thus, the fan frame 2 of this disclosure can provide the effect of reducing the operation noise.

In this embodiment, the fan frame 2 further comprises a center connection portion 23, and the static blades 222 connect to the base 21 through the center connection portion 23. As shown in FIGS. 2A and 2B, the center connection portion 23, the static blades 222, and the metal frame wall 221 are integrally formed as one piece. In particular, although the figures show that the center connection portion 23, the static blades 222, and the metal frame wall 221 are integrally formed as one piece, the center connection portion 23, in practice, can also be an individual structure separated from the static blades 222 and the metal frame wall 221. This disclosure is not limited. In addition, the center connection portion 23, the static blades 222, the metal frame wall 221, and the base 21 can be integrally formed as one piece, and this disclosure is not limited thereto. As shown in FIG. 2A, the center connection portion 23 is an annular structure. Of course, the center connection portion 23 can also be a polygonal structure, an arc structure, a circular structure, an elliptical structure, or an irregular structure, and this disclosure is not limited. In addition, the center connection portion 23, for example, connects to all of the static blades 222. In other embodiments, the center connection portion 23 can connect to two or more of the static blades 222 only, and this disclosure is not limited thereto.

In this embodiment, a height H4 of the frame body 22 is greater than a height H5 of the metal frame wall 221, and the height H5 of the metal frame wall 221 is greater than a thickness H6 of the center connection portion 23. This design of different heights can effectively decrease the operation noise of the fan configured with the fan frame 2 of this disclosure.

Figure 3:
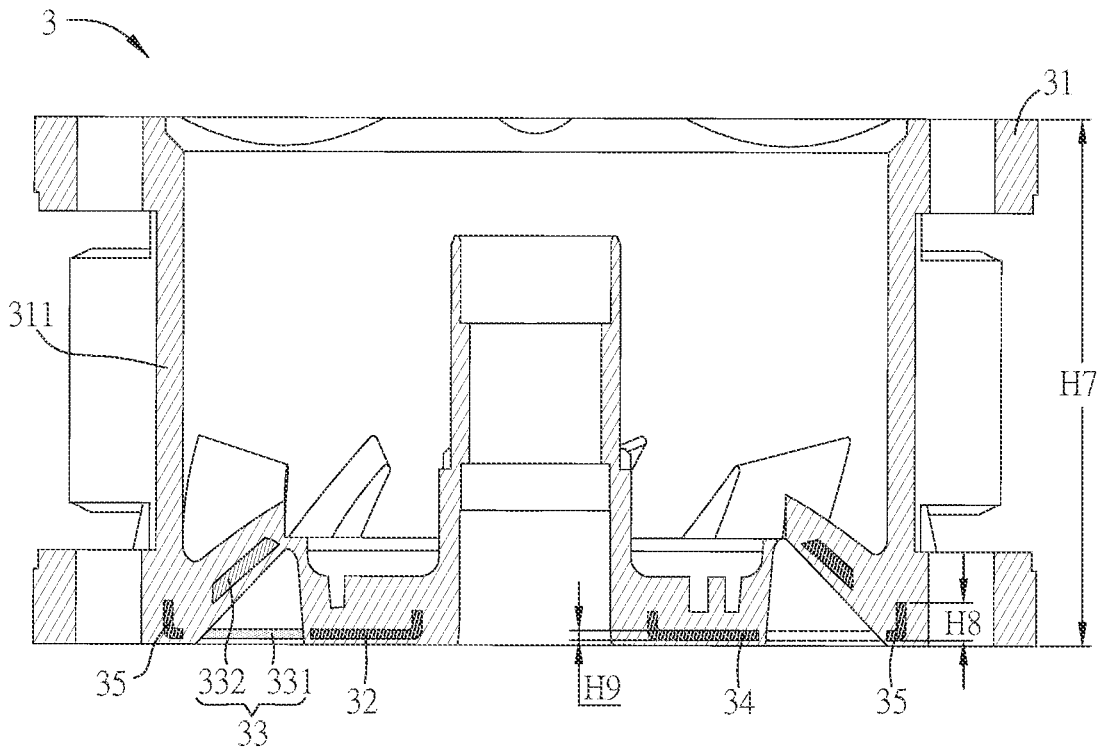
FIG. 3 is a sectional view of a fan frame according to another embodiment of this disclosure.

FIG. 3 is a schematic diagram showing a fan frame 3 according to another embodiment of this disclosure.

Referring to FIG. 3, the fan frame 3 comprises a frame body 31, a base 32, and a plurality of static blades 33. The frame body 31 comprises a frame wall 311. One end of each static blade 33 connects to the base 32, and the other end of each static blade 33 connects to the frame wall 311. At least one part of the static blades 33 is made of metal.

In this embodiment, each static blade 33 comprises a supporting portion 331 and a wing portion 332 extending outwardly from the supporting portion 331. For example, the frame body 31 may cover the entire static blades 33, which include the supporting portions 331 and the wing portions 332). Alternatively, the frame body 31 may cover the supporting portions 331 of the static blades 33 only. Alternatively, the frame body 31 may cover the supporting portions 331 and a part of the wing portions 332 of the static blades 33. Alternatively, the frame body 31 may cover the entire static blades 33 and the entire base 32. Alternatively, the frame body 31 may cover the supporting portions 331 and a part of the wing portions 32 of the static blades 33, and the entire base 32. Alternatively, the frame body 31 may cover the entire static blades 33 and at least one part of the base 32. Alternatively, the frame body 31 may cover the supporting portions 331 of the static blades 33 and at least one part of the base 32. Alternatively, the frame body 31 may cover the supporting portions 331 and a part of the wing portions 332 of the static blades 33, and at least one part of the base 32. In this embodiment, the frame body 31 is made of plastic material, and the base 32 can be, for example but not limited to, all made of metal, at least partially covered by the frame body 31 to form a part of plastic material and a part of metal, an inner metal layer with a partial external plastic layer, an inner metal layer with an external plastic layer, or integrated with the frame body 31 to form a whole plastic integrated piece. This disclosure is not limited. In addition, the static blades 33 can be, for example, all made of metal, at least partially covered by the frame body 31 to form a part of plastic material and a part of metal, an inner metal layer with a partial external plastic layer, or an inner metal layer with an external plastic layer. This disclosure is not limited. The design of the materials of the frame body 31, the base 32, and the static blades 33 can increase the effective air quantity and airflow speed outputted by the operating fan containing the fan frame 3 of this disclosure. In addition, the configuration of the combination of different materials can disperse the resonance of the frame body for blocking the direct transmission of the vibration source, thereby decreasing the transmitted energy from the vibration source. Thus, the fan frame 1 of this disclosure can provide the effect of reducing the operation noise.

In this embodiment, the fan frame 3 further comprises a center connection portion 34, and the static blades 33 connect to the base 32 through the center connection portion 34. As shown in FIG. 3, the center connection portion 34, the static blades 33, and the base 32 are integrally formed as one piece. In particular, although the figure shows that the center connection portion 34, the static blades 33, and the base 32 are integrally formed as one piece, the center connection portion 34, in practice, can also be an individual structure separated from the static blades 33 and the base 32. In addition, the static blades 33 can be individual structures separated from the center connection portion 34 and the base 32, and the base 32 can be an individual structure separated from the center connection portion 34 and the static blades 33. This disclosure is not limited. In addition, the center connection portion 34 can be, for example, an annular structure, a polygonal structure, an arc structure, a circular structure, an elliptical structure, or an irregular structure, and this disclosure is not limited. In addition, the center connection portion 34 can connect to all of the static blades 33. In other embodiments, the center connection portion 34 can connect to two or more of the static blades 33 only, and this disclosure is not limited thereto.

In this embodiment, the fan frame 3 further comprises a peripheral connection portion 35, and the static blades 33 connect to the frame wall 311 through the peripheral connection portion 35. In particular, the peripheral connection portion 35, the static blades 33, and the frame wall 311 can be integrally formed as one piece (not shown). Alternatively, the peripheral connection portion 35 can be an individual structure separated from the static blades 33 and the frame wall 311, or the static blades 33 can be an individual structure separated from the peripheral connection portion 35 and the frame wall 311, or the frame wall 311 can be an individual structure separated from the peripheral connection portion 35 and the static blades 33. This disclosure is not limited. Moreover, the peripheral connection portion 35, the center connection portion 34, the static blades 33, and the base 32 can be integrally formed as one piece, or the frame wall 311, the peripheral connection portion 35, the center connection portion 34, the static blades 33, and the base 32 can be integrally formed as one piece. This disclosure is not limited thereto. In addition, the peripheral connection portion 35 can be, for example but not limited to, an annular structure, a polygonal structure, an arc structure, a circular structure, an elliptical structure, or an irregular structure, and this disclosure is not limited. Furthermore, the peripheral connection portion 35 may connect to all of the static blades 33. In other embodiments, the peripheral connection portion 35 can connect to two or more of the static blades 33 only, and this disclosure is not limited thereto.

In this embodiment, a height H7 of the frame wall 311 is greater than a height H8 of the peripheral connection portion 35, and the height H8 of the peripheral connection portion 35 is greater than a thickness H9 of the center connection portion 34. This design of different heights can effectively decrease the operation noise of the fan configured with the fan frame 3 of this disclosure.

In summary, this disclosure is to change the materials of the frame wall, base and static blades of the fan frame. In particular, at least one or a combination of the frame wall, the base and the static blades is all made of metal material, or is a structure containing a part of metal and partially covered by the plastic frame. Accordingly, the static blades and the other parts of the fan frame are made of different materials. Since the different materials have different vibration properties, the fan frame, which are made of different materials, can disperse the vibration of the fan frame, thereby preventing the resonance of the fan frame. Thus, the fan containing the fan frame of this disclosure can stably operate and reduce the generated noise, thereby extending the lifetime of the fan and maintaining the operation performance of the fan. In addition, although the fan frame is made of different materials, it is still possible to provide one material (e.g. a plastic material) to cover a part of the other material (e.g. a metal material), so that the fan frame can be manufactured as an integrated piece. This configuration can decrease the manufacturing cost and speed the manufacturing process.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan frame, comprising:

a metal base having a center portion, a plurality of supporting portions with strip shapes and a plurality of wing portions, wherein each of the supporting portions has a head end, a middle part and a tail end, the head end connects to a peripheral part of the center portion, the wing portions extend outwardly at an angle from the middle parts of the supporting portions, respectively; and a frame body having a frame wall, wherein the wing portions are at least partially cladded and contacted by the frame body.

2. The fan frame according to claim 1, wherein the angle is an obtuse angle.

3. The fan frame according to claim 1, wherein frame body is made of plastic.

4. The fan frame according to claim 1, wherein the wing portions are flat structures.

5. The fan frame according to claim 1, wherein the frame wall is made of metal, the supporting portions radially extend from the frame wall inwardly and connect to the center portion.

6. The fan frame according to claim 1, wherein the center portion, the supporting portions and the wing portions are integrally formed as one piece.

7. The fan frame according to claim 1, further comprising:

a peripheral connection portion, wherein the peripheral connection portion is an annular structure, the tail ends of the supporting portions connect to the peripheral connection portion.

8. The fan frame according to claim 7, wherein the center portion, the supporting portions, the wing portions and the peripheral connection portion are integrally formed as one piece.

9. The fan frame according to claim 7, wherein a height of the frame wall is greater than a height of the peripheral connection portion.

10. The fan frame according to claim 7, wherein a height of the peripheral connection portion is greater than a thickness of the center portion.

11. The fan frame according to claim 7, wherein the center portion, the supporting portions, the wing portions and the peripheral connection portion are cladded and contacted by the frame body.

12. The fan frame according to claim 1, wherein the center portion, the supporting portions and parts of the wing portions are cladded and contacted by the frame body.

13. The fan frame according to claim 1, wherein the center portion, the supporting portions and the wing portions are cladded and contacted by the frame body.

14. The fan frame according to claim 1, wherein the supporting portions and the wing portions form a plurality of static blades.

15. A fan frame, comprising:

a metal base having a peripheral connection portion, a plurality of supporting portions with strip shapes and a plurality of wing portions, wherein each of the supporting portions has a head end, a middle part and a tail end, the tail end connects to an inner periphery of the peripheral connection portion, the wing portions extend outwardly at an angle from the middle parts of the supporting portions, respectively; and a frame body having a frame wall, wherein the wing portions are at least partially cladded and contacted by the frame body.

16. The fan frame according to claim 15, wherein the angle is an obtuse angle.

17. The fan frame according to claim 15, wherein frame body is made of plastic.

18. The fan frame according to claim 15, wherein the wing portions are flat structures.

19. The fan frame according to claim 15, wherein the supporting portions, the wing portions and the peripheral connection portion are cladded and contacted by the frame body.

20. The fan frame according to claim 15, wherein a height of the frame wall is greater than a height of the peripheral connection portion.

* * * * *